US007296578B2

(12) United States Patent
Read, Jr.

(10) Patent No.: US 7,296,578 B2
(45) Date of Patent: Nov. 20, 2007

(54) EQUIPMENT AND METHODS FOR MANUFACTURING CIGARETTES

(75) Inventor: Louis John Read, Jr., Winston-Salem, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 484 days.

(21) Appl. No.: 10/793,179

(22) Filed: Mar. 4, 2004

(65) Prior Publication Data

US 2005/0194014 A1 Sep. 8, 2005

(51) Int. Cl.

| | |
|---|---|
| ***A24C 1/12*** | (2006.01) |
| *A24C 1/01* | (2006.01) |
| *A24C 1/42* | (2006.01) |
| *A24C 1/34* | (2006.01) |
| *A24C 5/47* | (2006.01) |

(52) U.S. Cl. ..... 131/57.5; 131/94; 131/27.1; 131/37; 131/106; 131/284

(58) Field of Classification Search ..... 131/284
See application file for complete search history.

(56) References Cited

U.S. PATENT DOCUMENTS

| | | | | |
|---|---|---|---|---|
| 1,909,924 | A | | 5/1933 | Schweitzer |
| 1,996,002 | A | | 3/1935 | Seaman |
| 1,999,223 | A | | 4/1935 | Weinberger |
| 1,999,224 | A | | 4/1935 | Miles |
| 2,013,508 | A | | 9/1935 | Seaman |
| 2,809,640 | A | | 10/1957 | Oldenkamp |
| 3,030,963 | A | | 4/1962 | Cohn |
| 3,093,143 | A | * | 6/1963 | Rudszinat et al. ..... 131/94 |
| 3,288,147 | A | | 11/1966 | Molins et al. |
| 3,308,600 | A | | 3/1967 | Erdmann et al. |
| 3,320,110 | A | * | 5/1967 | Gallagher ..... 156/438 |
| 3,915,176 | A | | 10/1975 | Heitmann et al. |

(Continued)

FOREIGN PATENT DOCUMENTS

WO WO 02/043513 A1 6/2002

(Continued)

OTHER PUBLICATIONS

Bombick, et al., *Fund. Appl. Toxicol.*, 39, p. 11-17 (1997).

(Continued)

*Primary Examiner*—Carlos Lopez
*Assistant Examiner*—Michael J. Felton
(74) *Attorney, Agent, or Firm*—Brinks Hofer Gilson & Lione

(57) ABSTRACT

An additive material is applied to a substrate, such as a paper web used as a wrapping material for cigarette manufacture. A predetermined pattern of additive material is applied to the outer surface of the wrapping material of a formed cigarette, and most preferably of a formed filtered cigarette. In particular, an application system for applying additive material of a controlled type, in a controlled manner and in a controlled location on the wrapping material of a formed two-up filtered cigarette rod is located within a tipping machine. During controlled rotation of each such formed rod (e.g., due to cooperation of (i) a roll drum, and (ii) cooperating roll block and star drum), additive material is applied to the outer surface of a desired location of the wrapping material of each such rod.

15 Claims, 3 Drawing Sheets

U.S. PATENT DOCUMENTS 4,077,415 A 3/1978 Preston et al.
4,111,740 A * 9/1978 Molins et al. ..... 156/498
4,146,040 A 3/1979 Cohn
4,236,535 A 12/1980 Schmidt et al.
4,237,907 A 12/1980 Pawelko et al.
4,280,187 A 7/1981 Reuland et al.
4,281,670 A 8/1981 Heitmann et al.
4,291,713 A 9/1981 Frank
4,340,074 A 7/1982 Tudor
4,361,156 A 11/1982 Hall
4,431,010 A 2/1984 Seragnoli
4,452,259 A 6/1984 Norman et al.
4,474,190 A 10/1984 Brand
4,480,650 A 11/1984 Weinert
4,489,738 A * 12/1984 Simon ..... 131/349
4,492,238 A * 1/1985 Wheless ..... 131/94
4,500,770 A 2/1985 Vock et al.
4,508,525 A 4/1985 Berger
4,565,202 A 1/1986 Seragnoli et al.
4,574,816 A 3/1986 Rudszinat
4,583,558 A * 4/1986 Luke ..... 131/284
4,600,027 A 7/1986 Houck et al.
4,607,647 A 8/1986 Dashley
4,615,345 A 10/1986 Durocher
4,736,754 A 4/1988 Heitmann et al.
4,739,775 A 4/1988 Hampl, Jr. et al.
4,781,203 A 11/1988 La Hue
4,781,204 A 11/1988 Barbe et al.
4,807,809 A 2/1989 Pryor et al.
4,825,883 A 5/1989 Hinz et al.
4,827,947 A 5/1989 Hinz
4,836,224 A 6/1989 Lawson et al.
4,841,993 A 6/1989 Hinz et al.
4,844,100 A 7/1989 Holznagel
4,878,506 A 11/1989 Pinck et al.
4,889,140 A 12/1989 Lorenzen et al.
4,889,145 A 12/1989 Adams
4,920,990 A 5/1990 Lawrence et al.
4,924,888 A 5/1990 Perfetti et al.
5,012,823 A 5/1991 Keritsis et al.
5,012,829 A 5/1991 Thesing et al.
5,025,814 A 6/1991 Raker
5,056,537 A 10/1991 Brown et al.
5,060,665 A 10/1991 Heitmann
5,060,668 A 10/1991 Weinhold
5,060,675 A 10/1991 Milford et al.
5,074,320 A 12/1991 Jones, Jr. et al.
5,101,839 A 4/1992 Jakob et al.
5,105,834 A 4/1992 Saintsing et al.
5,105,838 A 4/1992 White et al.
5,156,169 A 10/1992 Holmes et al.
5,159,942 A 11/1992 Brinkley et al.
5,191,906 A 3/1993 Myracle, Jr.
5,220,930 A 6/1993 Gentry
5,261,423 A 11/1993 Gaudlitz et al.
5,263,999 A 11/1993 Baldwin et al.
5,271,419 A 12/1993 Arzonico et al.
5,360,023 A 11/1994 Blakley et al.
5,417,228 A 5/1995 Baldwin et al.
5,450,863 A 9/1995 Collins et al.
5,474,095 A 12/1995 Allen et al.
5,690,125 A 11/1997 Niemann et al.
5,715,844 A 2/1998 Young et al.
5,718,250 A 2/1998 Banerjee et al.
5,878,753 A 3/1999 Peterson et al.
5,878,754 A 3/1999 Peterson et al.
6,198,537 B1 3/2001 Bokelman et al.
6,285,006 B1 9/2001 Hyllberg
6,360,751 B1 3/2002 Fagg et al.
6,526,985 B1 3/2003 Dombeck
6,532,966 B1 3/2003 Dombeck
6,537,186 B1 3/2003 Veluz
6,595,218 B1 7/2003 Koller et al.
6,606,999 B2 8/2003 Crooks et al.
6,631,722 B2 10/2003 MacAdam et al.
6,647,878 B2 11/2003 Blau et al.
6,675,811 B2 1/2004 Dombeck
6,684,781 B1 2/2004 Saitoh
6,725,867 B2 4/2004 Peterson et al.
6,758,906 B2 7/2004 Maiwald et al.
6,789,548 B2 9/2004 Bereman
6,837,248 B2 1/2005 Zawadzki et al.
6,854,469 B1 2/2005 Hancock et al.
2002/0000235 A1 1/2002 Shafer et al.
2002/0014453 A1 2/2002 Lilly, Jr. et al.
2002/0020420 A1 2/2002 Xue et al.
2002/0092621 A1 7/2002 Suzuki
2002/0166563 A1 11/2002 Jupe et al.
2003/0075193 A1 4/2003 Li et al.
2003/0131859 A1 7/2003 Li et al.
2003/0131860 A1 7/2003 Ashcraft et al.
2003/0136419 A1 7/2003 Muller
2003/0145866 A1 8/2003 Hartman
2003/0145869 A1 8/2003 Kitao et al.
2003/0150466 A1 8/2003 Kitao et al.
2003/0154993 A1 8/2003 Paine, III et al.
2003/0168070 A1 9/2003 Xue et al.
2003/0172942 A1 9/2003 Schlisio
2003/0205235 A1 11/2003 Draghetti
2004/0084056 A1 5/2004 Lawson et al.
2004/0129281 A1 7/2004 Hancock et al.
2004/0231685 A1 11/2004 Patel et al.
2004/0255965 A1 12/2004 Perfetti et al.
2004/0261807 A1 12/2004 Dube et al.
2005/0028832 A1 2/2005 Kubo et al.
2005/0076929 A1 4/2005 Fitzgerald et al.
2005/0103355 A1* 5/2005 Holmes ..... 131/31

FOREIGN PATENT DOCUMENTS

WO WO 02/44700 A1 6/2002

OTHER PUBLICATIONS

Browne, *The Design of Cigarettes*, 3rd Ed., p. 43 (1990).
Davis, et al., *Tobacco Production, Chemistry and Technology*, (Eds.) (1999).
Gutcho, *Tobacco Flavoring Substances and Methods*, Noyes Data Corp. (1972).
Leffingwell, et al. *Tobacco Flavoring for Smoking Products* (1972).
Voges, *Tobacco Encyclopedia*, (Ed.) p. 44-45 (1984).
Hauni Operating Manual, MAX2, No. 78, Jun. 1997, pp. 13-49 through 13-81.

* cited by examiner

EQUIPMENT AND METHODS FOR MANUFACTURING CIGARETTES

FIELD OF THE INVENTION

The present invention relates to smoking articles, and in particular, to equipment and techniques used for the manufacture of those smoking articles. More specifically, the present invention relates to the manufacture of cigarette rods, and in particular, to systems and methods for applying an additive material to desired locations of wrapping materials of cigarettes in an efficient, effective and desired manner.

BACKGROUND

Smoking articles, such as cigarettes, have a substantially cylindrical rod-shaped structure and include a charge, roll, or column of smokable material, such as shredded tobacco, surrounded by a paper wrapper, to form a "cigarette rod," "smokable rod" or a "tobacco rod." Normally, a cigarette has a cylindrical filter element aligned in an end-to-end relationship with the tobacco rod. Typically, a filter element comprises plasticized cellulose acetate tow circumscribed by a paper material known as "plug wrap." Certain cigarettes incorporate filter elements comprising, for example, activated charcoal particles. Typically, the filter element is attached to one end of the tobacco rod using a circumscribing wrapping material known as "tipping paper."

A cigarette is used by a smoker by lighting one end of that cigarette, and burning the tobacco rod. The smoker then receives mainstream smoke into his or her mouth by drawing on the opposite end of the cigarette. During the time that the cigarette is not being drawn upon by the smoker, the cigarette remains burning.

Numerous attempts have been made to control the manner that a cigarette burns when the cigarette is not being drawn upon. For example, cigarette papers have been treated with various materials to cause cigarettes incorporating those papers to self extinguish during periods when those cigarettes are lit but are not being actively puffed. Certain treatment methods have involved applying materials to the paper in circumferential bands or longitudinal stripes, creating areas that affect the burn rate of cigarettes incorporating those cigarette papers. See, for example, U.S. Pat. No. 3,030,963 to Cohn; U.S. Pat. No. 4,146,040 to Cohn; U.S. Pat. No. 4,489,738 to Simon; U.S. Pat. No. 4,489,650 to Weinert; U.S. Pat. No. 4,615,345 to Durocher; and U.S. Pat. No. 6,606,999 to Crooks et al.; U.S. Patent Application Pub. No. 2003/0145869 to Kitao et al.; U.S. Patent Application Pub. No. 2003/0150466 to Kitao et al.; and U.S. patent application Ser. No. 09/892,834, filed Jun. 27, 2001 to Hancock et al.; Ser. No. 10/645,996, filed Aug. 22, 2003 to Hancock et al.; Ser. No. 10/665,066, filed Sep. 17, 2003 to Patel et al.; and Ser. No. 10/682,582, filed Oct. 9, 2003 to Fitzgerald et al. In addition, numerous references disclose applying films to the paper wrapping materials of tobacco rods. See, for example, U.S. Pat. No. 1,909,924 to Schweitzer; U.S. Pat. No. 4,607,647 to Dashley; and U.S. Pat. No. 5,060,675 to Milford et al.; and U.S. Patent Application Publication No. 2003/0131860 to Ashcraft et al.

"Banded" paper wrapping materials that are used for cigarette manufacture possess segments defined by the composition, location, and properties of the various materials within those wrapping materials. Numerous references contain disclosures suggesting various banded wrapping material configurations. See, for example, U.S. Pat. No. 1,996, 002 to Seaman; U.S. Pat. No. 2,013,508 to Seaman; U.S. Pat. No. 4,452,259 to Norman et al.; U.S. Pat. No. 5,417,228 to Baldwin et al.; U.S. Pat. No. 5,878,753 to Peterson et al.; U.S. Pat. No. 5,878,754 to Peterson et al.; and U.S. Pat. No. 6,198,537 to Bokelman et al.; and PCT Application Pub. No. WO 02/37991. Methods for manufacturing banded-type wrapping materials also have been disclosed. See, for example, U.S. Pat. No. 4,739,775 to Hampl, Jr. et al.; and U.S. Pat. No. 5,474,095 to Allen et al.; and PCT Application Pub. Nos. WO 02/44700 and WO 02/055294. Some of those references describe banded papers having segments of paper, fibrous cellulosic material, or particulate material adhered to a paper web. See, U.S. Pat. No. 5,263,999 to Baldwin et al.; U.S. Pat. No. 5,417,228 to Baldwin et al.; and U.S. Pat. No. 5,450,863 to Collins et al.; and U.S. Patent Application Pub. No. 2002/0092621 to Suzuki. Methods for manufacturing cigarettes having treated wrapping materials are set forth in U.S. Pat. No. 1,999,223 to Weinberger; U.S. Pat. No. 1,999,224 to Miles; and U.S. Pat. No. 5,191,906 to Myracle, Jr. et al.; and PCT Application Pub. No. WO 02/19848.

It would be desirable to apply additive material in a controlled manner as a predetermined pattern (e.g., as bands) to smoking articles during the manufacturing processes associated with the production of those smoking articles. It also would be highly desirable to provide cigarettes having predetermined patterns of additive materials (e.g., as bands) applied in desired locations to the wrapping materials of those cigarettes, particularly during processes associated with cigarette manufacture.

BRIEF SUMMARY

The present invention relates to materials, systems, apparatus, and methods for manufacturing smoking articles, such as cigarettes. Certain preferred aspects of the present invention relate to manners and methods for transferring additive material to, and retaining an additive material on, a wrapping material of a smoking article during manufacture of smoking articles using a conventional type of automated filtered cigarette making machine. That is, preferred aspects of the present invention relate to an automated filtered cigarette making machine system adapted to apply an additive material (e.g., as a coating formulation) to cigarette rods. In the most highly preferred aspects of the present invention, the automated cigarette making machine can operate so as to apply a desired additive material, in a desired amount, in a desired configuration, in a desired location, on a manufactured cigarette rod of a filtered cigarette.

The present invention relates to equipment and methods for applying an additive material to a substrate, such as a paper wrapping material of the type employed for cigarette manufacture. The equipment and methods are particularly suitable in connection with the operation of an automated cigarette making machine, and for the purpose of applying a predetermined pattern of additive material to the wrapping material of a formed filtered cigarette. In particular, an application system located within a tipping machine is used for applying additive material of a controlled type, in a controlled manner, in a controlled amount, and in a controlled location on the wrapping material of a formed two-up filtered cigarette rod. During controlled rotation of each of the components that comprise a formed two-up filtered cigarette rod (e.g., due to cooperation of a roll drum and roll block, or other suitable components within the tipping machine), the application system is used to apply additive material to the outer surface of desired locations of the wrapping material of each such rod.

Features of the foregoing aspects and embodiments of the present invention can be accomplished singularly, or in combination, in one or more of the foregoing. As will be appreciated by those of ordinary skill in the art, the present invention has wide utility in a number of applications as illustrated by the variety of features and advantages discussed below. As will be realized by those of skill in the art, many different embodiments of the foregoing are possible. Additional uses, objects, advantages, and novel features of the present invention are set forth in the detailed description that follows and will become more apparent to those skilled in the art upon examination of the following or by practice of the invention.

DETAILED DESCRIPTION OF THE DRAWINGS AND THE PRESENTLY PREFERRED EMBODIMENTS

Figures 1, 2:
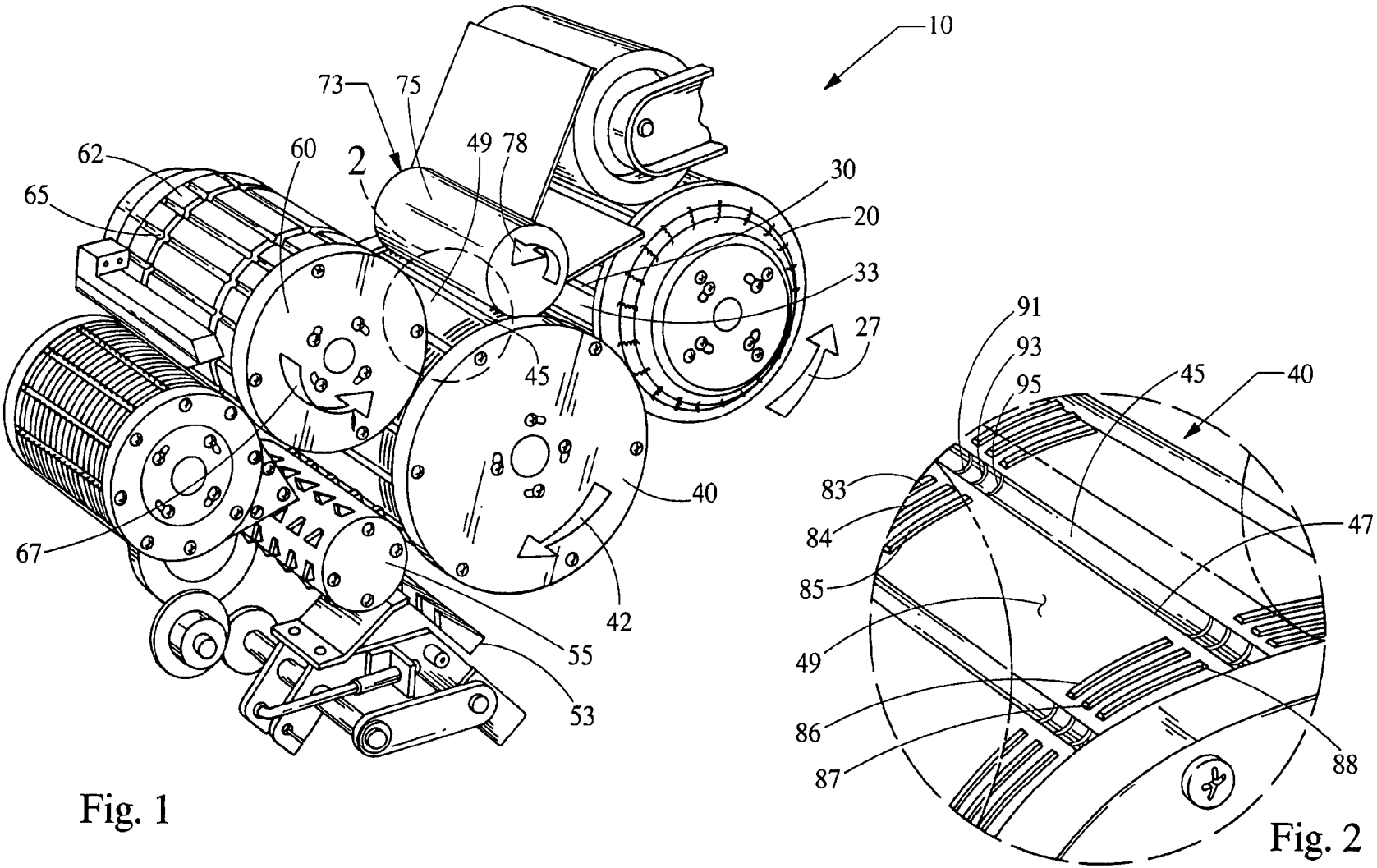
FIG. 1 is a perspective of a portion of a tipping region of a filtered cigarette making machine.
FIG. 2 is a representation of one embodiment of the face of roll drum shown in FIG. 1.

Aspects and embodiments of the present invention include cigarette making machines and components thereof that are useful for manufacturing cigarettes, and in particular, that are useful for transferring and retaining additive material on a paper wrapping web in an efficient, effective and desired manner. FIGS. 1 through 5 illustrate those aspects and embodiments. Like components are given like numeric designations throughout the figures.

A conventional automated cigarette rod making machine useful in carrying out the present invention is of the type commercially available from Molins PLC or Hauni-Werke Korber & Co. KG. For example, cigarette rod making machines of the type known as Mk8 (commercially available from Molins PLC) or PROTOS (commercially available from Hauni-Werke Korber & Co. KG) can be employed, and can be suitably modified in accordance with the present invention. A description of a PROTOS cigarette making machine is provided in U.S. Pat. No. 4,474,190 to Brand, at col. 5, line 48 through col. 8, line 3, which is incorporated herein by reference. Types of equipment suitable for the manufacture of cigarettes also are set forth in U.S. Pat. No. 4,781,203 to La Hue; U.S. Pat. No. 4,844,100 to Holznagel; U.S. Pat. No. 5,156,169 to Holmes et al.; U.S. Pat. No. 5,191,906 to Myracle, Jr. et al.; and U.S. Pat. No. 6,647,870 to Blau et al.; U.S. Patent Application Pub. No. 2003/0145866 to Hartman; U.S. Patent Application Pub. No. 2003/0145869 to Kitao et al.; U.S. Patent Application Pub. No. 2003/0150466 to Kitao et al.; U.S. patent application Ser. No. 10/645,996, filed Aug. 22, 2003 to Hancock et al. and Ser. No. 10/665,066, filed Sep. 17, 2003 to Patel et al.; and PCT Application Pub. No. WO 02/19848; which are incorporated herein by reference. Designs of various components of cigarette making machines, and the various material used to manufacture those components, will be readily apparent to those skilled in the art of cigarette making machinery design and operation. For example, descriptions of the components and operation of several types of chimneys, tobacco filler supply equipment, suction conveyor systems and garniture systems are set forth in U.S. Pat. No. 3,288,147 to Molins et al.; U.S. Pat. No. 3,915,176 to Heitmann et al; U.S. Pat. No. 4,291,713 to Frank; U.S. Pat. No. 4,574,816 to Rudszinat; U.S. Pat. No. 4,736,754 to Heitmann et al. U.S. Pat. No. 4,878,506 to Pinck et al.; U.S. Pat. No. 5,060,665 to Heitmann; U.S. Pat. No. 5,012,823 to Keritsis et al. and U.S. Pat. No. 6,630,751 to Fagg et al.; and U.S. Patent Application Pub. No. 2003/0136419 to Muller; which are incorporated herein by reference. Automated cigarette making machines provide means for supplying or otherwise providing a formed continuous cigarette rod or smokable rod that can be subdivided into formed smokable rods of desired lengths.

Cigarette rods then most preferably have filter elements attached thereto, using known types of components, techniques and equipment. For example, the cigarette rod making machine can be suitably coupled to filter tipping machine, such as a machine available as a MAX, MAX S or MAX 80 Hauni-Werke Korber & Co. KG. See, also, for example, U.S. Pat. No. 3,308,600 to Erdmann et al. and U.S. Pat. No. 4,280,187 to Reuland et al; which are incorporated herein by reference. Various manners and methods for attaching filter elements to cigarette rods are set forth in U.S. Pat. No. 2,809,640 to Oldenkamp; U.S. Pat. No. 4,077,415 to Preston et al.; U.S. Pat. No. 4,236,535 to Schmidt et al.; U.S. Pat. No. 4,237,907 to Pawelko et al.; U.S. Pat. No. 4,340,074 to Tudor; U.S. Pat. No. 4,361,156 to Hall; U.S. Pat. No. 4,431,010 to Seragnoli; U.S. Pat. No. 4,583,558 to Luke; and U.S. Pat. No. 4,841,993 to Hinz et al; and U.S. Patent Application Pub. Nos. 2003/0172942 to Schlisio and 2003/0205235 to Draghetti; which are incorporated herein by reference. As such, there are provided manners or methods for supplying a series of two-up filtered cigarette rods, each having two smokable rods and filter element of double length therebetween. Typically, a web of tipping paper is supplied, adhesive is applied to one side of the paper web, the web is cut to provide a segment of desired size, the segment is applied to the aligned dual filter and tobacco rods, and rotation of the components causes the paper segment to wrap around the filter and tobacco rod components.

Representative manners and methods for perforating manufactured cigarettes using laser systems are set forth in U.S. Pat. No. 4,281,670 to Heitmann et al.; U.S. Pat. No. 4,500,770 to Vock et al.; U.S. Pat. No. 4,565,202 to Seragnoli et al; U.S. Pat. No. 4,600,027 to Houck et al.; U.S. Pat. No. 4,825,883 to Hinz et al.; U.S. Pat. No. 4,889,140 to Lorenzen et al.; U.S. Pat. No. 5,060,668 to Weinhold; and U.S. Pat. No. 6,675,811 to Dombeck; U.S. patent application Ser. No. 10/713,569, filed Nov. 13, 2003 to Holmes; and EP Application No. 1072200 to Dombeck; which are incorporated herein by reference. Methods for rolling cigarettes in controlled manners (e.g., providing controlled rotation) in order that regions of those cigarettes can be appropriately treated (e.g., using laser systems) are set forth in U.S. Pat. No. 4,781,204 to Barbe et al.; U.S. Pat. No. 4,827,947 to Hinz; U.S. Pat. No. 5,690,125 to Niemann et al.; U.S. Pat. No. 6,526,985 to Bombeck; and U.S. Pat. No. 6,532,966 to Dombeck; which are incorporated herein by reference. As such, there is provided manners and methods for rotating each cigarette rod (e.g., each two-up filtered cigarette rod) about its longitudinal axis in a controlled manner.

Referring to FIG. 1, there is shown a portion of an automated cigarette tipping machine 10, and in particular, a portion of a MAX 80 tipping machine unit available from Hauni-Werke Korber & Co. KG. The tipping machine 10 includes a swash drum 20 that is adapted to rotate, for example, in a counter-clockwise direction, as is shown by arrow 27 adjacent to that drum. Swash drum 20 possesses a plurality or series of spaced pockets, flutes or grooves 30 across its peripheral roll face 33. Two tobacco rods (not shown) and a double length filter element (not shown) are placed at a predetermined location within each groove of the roll face of swash drum 20.

A continuous web of tipping paper (not shown) has an adhesive (not shown) applied to one of its major faces (i.e., the inner face), and is properly sized as a patch (not shown). The patch is appropriately positioned across the double length filter element (not shown) and adjacent end regions of each tobacco rod (not shown). Techniques for selecting tipping materials, providing patches of tipping material from a web of tipping material, applying adhesive at appropriate locations on one side of the tipping material, and adhering the patch to the double length filter element and the tobacco rods, will be readily apparent to those skilled in the art of filtered cigarette design and manufacture.

The tipping machine 10 also includes a roll drum 40 that is adapted to rotate, for example, in a clockwise direction, as is shown by arrow 42 within that drum. Roll drum 40 also possesses a plurality or series of spaced pockets, flutes or grooves 45 across its peripheral roll face 49. The respective roll faces of swash drum 20 and roll drum 40 cooperate with one another. As such, each assembly (not shown) of tipping patch, double length filter element and tobacco rods within each groove in the roll face of swash drum 20 is transferred to a corresponding groove in the roll face of roll drum 40.

Figure 4:
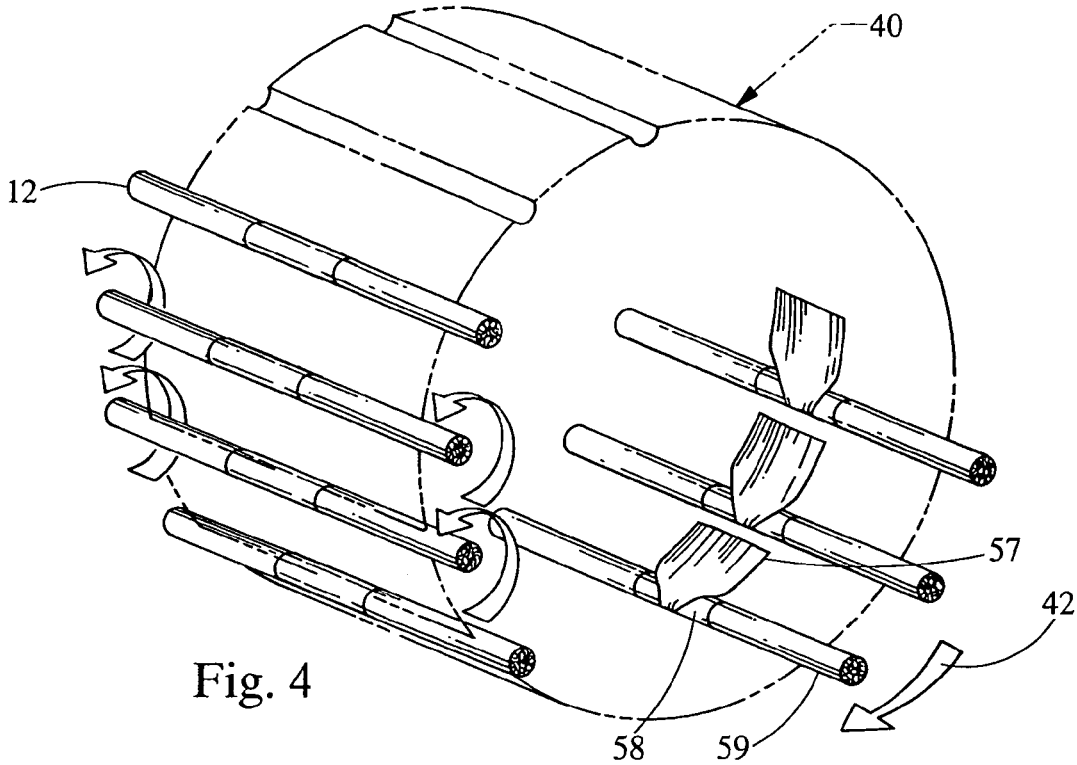
FIG. 4 is a perspective of the roll drum shown in FIG. 3 having two-up cigarette rods rotated thereon.

Positioned adjacent to roll drum 40 are a block 53 and a star drum 55. Referring also to FIG. 4, as roll drum 40 rotates in cooperation with the block 53 and star drum 55, each assembly of tipping patch 57, double length filter element 58 and tobacco rods 59 within each groove in the roll face of roll drum 20 undergoes multiple revolutions (e.g., from about 2 to about 4 revolutions), thus causing a wrapping of the tipping patch around the filter element and adjacent regions of the two tobacco rods. As such, a double length or "two-up" cigarette 12 is provided.

After the two-up cigarette 12 on the roll drum 40 moves past the star drum 55, the two-up cigarette then is transferred to a groove 65 within the roll face 62 of transfer drum 60. The roll face of the transfer drum 60 possesses a plurality of spaced grooves in its roll face, and hence the transfer drum can carry a plurality of two-up filter cigarettes. Transfer drum 60 rotates in a counter-clockwise direction, as is shown by arrow 67 within that drum. Each groove of each drum is designed so as to receive, carry and transfer a two-up filtered cigarette rod or filtered cigarette assembly. That is, the various grooves are arranged so as to extend transversely to the direction of travel of the peripheral surface of each rotating drum. For the embodiment shown, a manufactured cigarette rod is carried and transported within a pocket of a first rotating drum and transferred to a pocket of a rotating second rotating drum. Although not shown, a series of such types of transfer drums can cooperate to transfer two-up filtered cigarette rods throughout various regions of the tipping machine. The design, assembly and operation of suitable drums that are used to transfer two-up filtered cigarette rods within an automated cigarette tipping machine will be readily apparent to those having skill in the art of cigarette manufacture.

A transfer roller 73 is positioned so that its roll face 75 is in contact with predetermined regions of the roll face 49 of the roll drum 40. Transfer roller 73 rotates in a counter-clockwise direction, as shown by arrow 78 in roller 73. Additive material (not shown), which typically has the form of a fluid or paste, appropriately applied to the roll face 75 of the transfer roll 73 thus can be applied to appropriate locations on the roll face 49 of the roll drum 40. The manner by which the additive material is applied to the roll face 75 of the transfer roller 73 can vary; and the amount of additive material that is applied to the roll face of the transfer roller can vary. For example, additive material can be applied to the roll face of the transfer roller using a spraying mechanism (not shown), a wiping or painting type of mechanism (not shown), a roll transfer mechanism (not shown), or other suitable means for appropriately transferring a desired amount of additive material from a source to desired locations of the roll face of the transfer roller. The selection, design and use of such general types of application mechanisms, and the design and use of doctor blades (not shown), and other suitable components associated with the transfer of additive material, will be apparent to those skilled in the art of fluid application using roll mechanisms. See, for example, the types of technologies set forth in U.S. patent application Ser. No. 10/682,582, filed Oct. 9, 2003 to Fitzgerald et al.

Most preferably, roll face 49 of the transfer roller 40 includes a series of printing surfaces, a preferred embodiment of which is shown in FIG. 2. Generally, such printing surfaces have predetermined shapes and are located at predetermined locations of the roll face of the transfer roller. Typically, the printing surfaces are surfaces that are slightly raised from the roll, such that additive material applied in a controlled manner as a coating or film on the roll face of the transfer roller 73 is transferred to the printing surfaces when the roll face 75 of the transfer roller contacts the printing surfaces of the roll face 49 of the roll drum 40. Alternatively, additive material can be applied using manners and methods similar to those used for application of print using printing barrels, using manners and methods similar to those used for application of adhesive material to tipping patch materials, using a series of cooperating rollers and doctor blades, using timed spraying mechanisms, by operating rollers at differing speeds to provide wiping types of actions, or by other suitable means. In use, additive material applied to the printing surfaces of the transfer roller then is applied to the appropriate location of the wrapping material regions of the two-up cigarette assembly when that assembly undergoes a series of revolutions across the printing surfaces at the appropriate region within the tipping machine 10.

Referring to FIG. 2, there is shown a preferred embodiment of a portion of the roll face 49 of the roll drum 40. The roll face 49 possesses grooves 45, 47. Between each of the grooves 45, 47 extend two series of printing surfaces in the form of lines 83, 84, 85 and 86, 87, 88 that extend essentially perpendicularly to the direction of the grooves. As such, rotation and transfer of a two-up cigarette assembly between groove 45 and groove 47 can cause additive material on each printing surface to be transferred to appropriate regions of the wrapping material of the two-up cigarette assembly. For the embodiment shown, the wrapping material of each tobacco rod is provided with a series of three circumscribing bands. Preferably, identical printing surfaces are located between each set of grooves around the roll face 49.

Preferably, the roll drum is provided with undercuts or recesses 91, 93 and 95 in the grooves 45. The recesses are aligned with the printing surfaces, such as described above, or aligned with the predetermined location where the additive material is applied to the two-up cigarette. In this manner, when the two-up cigarette rolls off the printing surface and into the groove, or after the additive material has otherwise been applied to the two-up cigarette, the portion of the outer wrapper of the two-up cigarette with additive material applied thereon does not come into direct contact with the surface of the groove. Recesses may be provided in other manners and on other transfer drums, as shown and described in connection with FIG. 5. This may be useful to minimize or prevent the additive material from accumulating or building up in the grooves.

Figure 3:
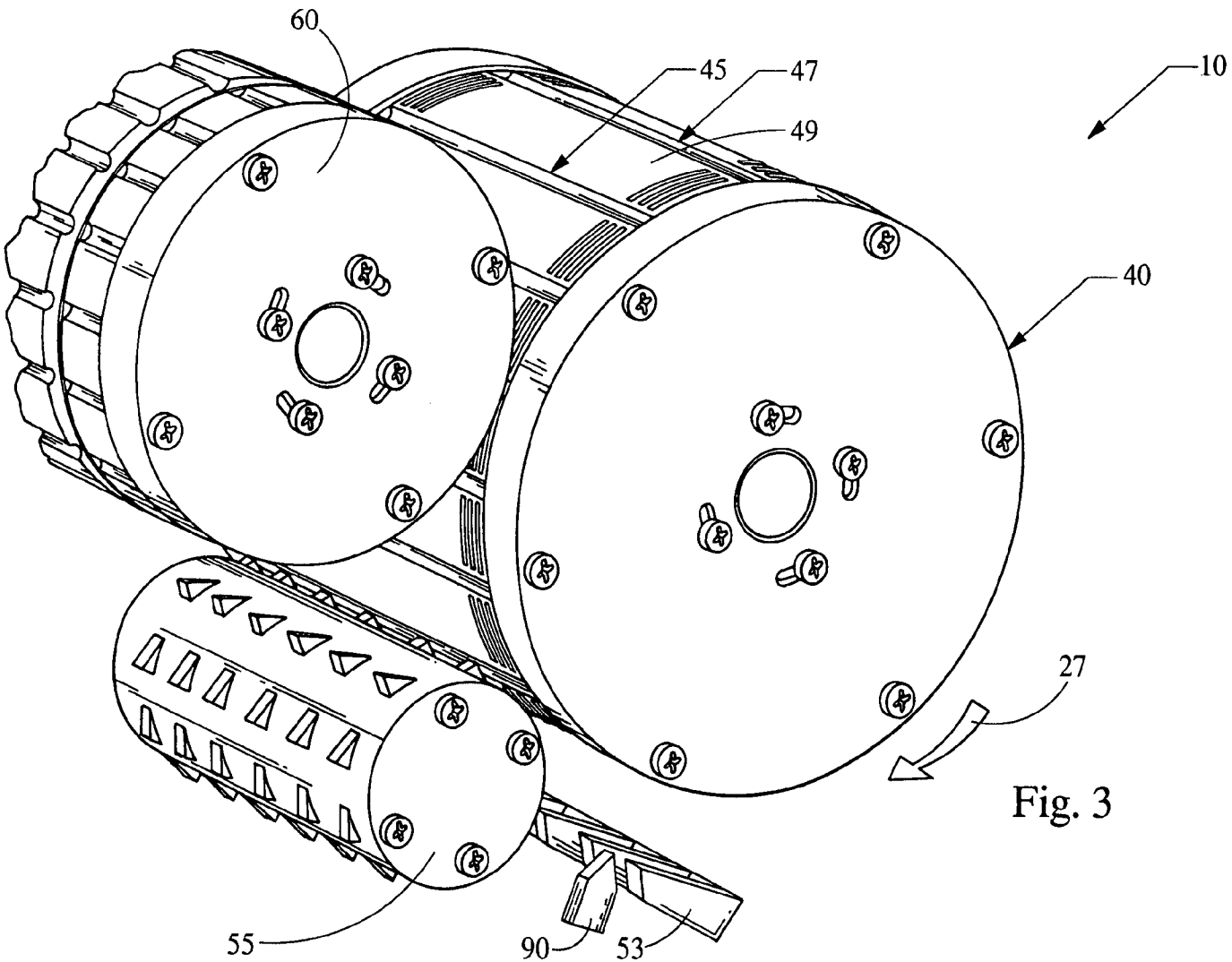
FIG. 3 is a perspective of a portion of a tipping region of a filtered cigarette making machine.

Referring to FIGS. 3 and 4, there is shown another preferred embodiment of a portion of an automated cigarette tipping machine 10, and in particular, a portion of a MAX 80 tipping machine unit available from Hauni-Werke Korber & Co. KG. The tipping machine 10 includes a roll drum 40 that is adapted to rotate, for example, in a clockwise direction, as is shown by arrow 27 adjacent to that drum. Roll drum 40 possesses a plurality or series of spaced pockets, flutes or grooves 45, 47 across its peripheral roll face 49. A two-up filtered cigarette assembly 12 is placed in each groove of the roll face of transfer drum 40. The tipping machine 10 also includes a roll hand or block 53 positioned relative to the transfer drum 40 such that the two-up filtered cigarette assembly undergoes revolutions so that the tipping patch 57 is wrapped around the other components of the two-up filtered cigarette assembly. In the region of the roll hand or block 53 is located a series of nozzles 90, that apply additive material to appropriate regions of the two-up cigarette. The tipping machine 10 also includes a transfer drum 60 and a star drum 55.

For a highly preferred embodiment, the transfer drum 40 and the block 53 cooperate such that the cigarette rod 59 undergoes controlled rotation (e.g., from about 2 to about 4 full revolutions), during which time that rod undergoes controlled translational movement. As such, during the period that each rod is rotated relative to the overall tipping machine 10, the application system 90 which is located in a predetermined location (e.g., in a fixed location relative to the overall tipping machine), can apply additive material in a controlled manner to a predetermined location on each rotating rod. That is, while the rod undergoes controlled rotation in the region of the tipping machine near the application system, additive material can be applied as a band around that rod as the rod undergoes that controlled rotation in that region. For example, for a rod undergoing at least two complete revolutions (e.g., at least a 720° rotation), additive material can be applied over a desired length of the rod, but so as to entirely encircle that rod (e.g., to apply additive material to the rod as a band). Then, the specific rod so treated to be transported away. Successively, each rod carried by the roll drum is treated in a like manner.

The application system 90 of the tipping machine 10 is equipped with a series of nozzles, spray jets, wipers, brushes (not shown) or other suitable means for carrying out controlled application of additive material to desired locations on the two-up filtered cigarette rod 12 using appropriate types of non-contact or contact application techniques. Such application systems most preferably are adapted so as to allow for the application of a predetermined pattern of the additive material to at least one predetermined region of the cigarette rod (e.g., a two-up filtered cigarette rod) as that rod is rotated. The application system can be designed so as to provide directed application of additive material over a very precise region (e.g., as a concentrated jet), or so as to provide application over a fairly broad region (e.g., as a type of spray). Nozzles or series of nozzles can be timed or constant application to provide a desired, controlled application. Representative types of applicator systems, deposition techniques, and coating formulations are set forth and referenced in U.S. Pat. No. 6,684,781 to Saitoh; U.S. patent application Ser. No. 10/645,996, filed Aug. 22, 2003 to Hancock et al.; Ser. No. 10/665,066, filed Sep. 17, 2003 to Patel et al.; and Ser. No. 10/682,582, filed Oct. 9, 2003 to Fitzgerald et al.; which are incorporated herein by reference. Representative applicators may include, but are not limited to, nozzle type applicators (e.g., ink jet-type printers), printing-type applicators (e.g., surface coating-type applicator wheels), and wiping-type applicators (e.g., felt tip or brush-type applicators).

Non-contact applicators most preferably are positioned so as to be close to the rod at the appropriate period during controlled application of additive material. Preferably, positioning and use of such non-contact applicators are sufficiently remote from the rod so as to not have any substantial adverse affect upon the operation of the first transfer drum, roll drum or transport of the rod by those drums. Contact-type applicators most preferably are positioned so as to contact the rod at the appropriate period during controlled application of additive material. However, positioning and use of such contact-type applicators preferably do not have any substantial adverse affect upon the operation of the first transfer drum, roll drum or transport of the rod by those drums.

The manner by which the various applicators are positioned within the tipping machine 10 can vary. Generally, the various application nozzles and contact-type applicators can be attached to, or otherwise supported by, the application system 90 by using or suitably adapting the general types of attachment mechanisms conventionally used to support laser emission systems that are used to apply rings of air dilution perforations to two-up filtered cigarette rods. The additive material can be applied in a controlled manner using a series of nozzles that are timed to apply desired amounts of additive material to desired locations at desirable times, or the series of nozzles can be adapted so as to provide an essentially constant application of additive material during high speed operation of the tipping machine. As such, the various components of each application system can be maintained in a desired location and position within the tipping machine 10. Those components of the application systems mounted within the tipping machine then can be suitably connected (e.g., using appropriate electronic components and materials transfer components) to appropriate control units and materials supply components that are located remote from the tipping machine.

Applicator systems are designed and operated so as to supply appropriate amounts of additive material to relevant application regions in the relevant vicinity of the rod, apply appropriate amounts of additive material at the desired locations of the rod, and apply appropriate amounts of additive material to the rod in the relevant period that the rod experiences controlled rotation.

As the components of the two-up filtered cigarette rod 12 is rotated in a controlled manner within the tipping machine 10, the various applicators can be used to apply in a controlled manner a ring, or a series of rings, of coating material to each cigarette (e.g., to each smokable rod portion). Due to the positioning of the applicators relative to the two-up cigarette rod, the type of band and the positioning of the band can be precisely controlled, and is most preferably very consistent for each cigarette rod. If desired, several applicators and/or transfer or roll drums can be assembled in series so that additive material can be applied to each rod a multiple number of times.

The application system can be operated in a controlled pulsed fashion. As such, additive material is applied to the two-up filtered cigarette rod only during periods during which that rod is undergoing rotation during controlled rotation within the tipping machine. However, the application system can be operated in a controlled continuous fashion. As such, additive material is applied to the desired region occupied by the two-up filtered cigarette rods as those rods undergo controlled rotation within the tipping machine. The precise method of application of additive material can depend upon factors such as the type, amount and form of additive material employed, and the manner of application can be determined by experimentation and can be a matter of design choice.

The tipping machine 10 may be equipped with an optional, though highly preferred, laser emission component unit (not shown) so as to provide for a manner or method for laser perforation of the two-up filtered cigarette rods (not shown). As such, the tipping machine 10 can be equipped with a laser system for the purpose of providing at least two rings of air dilution perforations in the double filter region 58 of each two-up filtered cigarette rod 12. That is, during controlled rotation of each rod, the filter regions of those rods can be laser perforated, using known techniques and equipment. For examples of exemplary techniques and equipment, see U.S. Pat. No. 4,281,670 to Heitmann et al.; U.S. Pat. No. 4,500,770 to Vock et al.; U.S. Pat. No. 4,565,202 to Seragnoli et al; U.S. Pat. No. 4,600,027 to Houck et al.; U.S. Pat. No. 4,825,883 to Hinz et al.; U.S. Pat. No. 4,889,140 to Lorenzen et al.; U.S. Pat. No. 5,060,668 to Weinhold; and U.S. Pat. No. 6,675,811 to Dombeck; U.S. patent application Ser. No. 10/713,569, filed Nov. 13, 2003 to Holmes; and EP Application No. 1072200 to Dombeck. The design and operation of suitable housing units, laser perforation components, optical systems, laser perforators and laser cams that are used in the processing of two-up filtered cigarette rods within an automated cigarette tipping machine will be readily apparent to those having skill in the art of cigarette manufacture.

After application of the additive material to each smokable rod portion of the two-up filtered cigarette rod, that rod can be subjected to further treatment so as to dry or set the additive material, and hence cause the additive material to adhere to the wrapping material of each smokable rod. As such, the additive material can have the form of a surface coating on the outer surface region of the wrapping material, or the additive material can permeate a desired region of the wrapping material. It is particularly preferred that the additive material, when dried or set, does not have a great propensity to (i) become smeared or removed from the wrapping material during normal handling operations, or (ii) cause neighboring cigarettes to become adhered to one another. The rod can be subjected to some change in heat (e.g., to the application of heat), or other suitable means for causing the desired amount of additive material to maintain physical contact with the wrapping material. Representative types of drying systems are those drying systems set forth in U.S. patent application Ser. No. 10/645,996, filed Aug. 22, 2003 to Hancock; Ser. No. 10/665,066, filed Sep. 17, 2003 to Patel et al.; and Ser. No. 10/682,582, filed Oct. 9, 2003 to Fitzgerald et al.; which are incorporated herein by reference. For example, microwave radiation can be focused on regions of the two-up cigarette rod that requires drying, or forced hot air convection drying in relevant regions of the tipping machine can be employed. Heat can be applied to the cigarette rods by employing heating mechanisms within the various transfer drums within the tipping machine. Certain regions of the tipping machine can possess transfer drums and associated transfer mechanism components that can be manufactured using suitable materials (e.g., plastic materials), and such regions can be subjected to microwave radiation in order to facilitate drying of additive material applied to two-up cigarette rods; and that region of the tipping machine can be enclosed in an appropriate enclosure. Alternatively, the various rods can be transferred on a conveyor system, passed through an appropriate enclosure, and subjected to application of appropriate heat.

After the processing of the cigarette is complete, the two-up filter cigarette can be further processed. The two-up cigarette can be cut so as to provide two filtered cigarettes. Those cigarettes can be turned using known techniques and equipment. The cigarettes can be inspected. Optionally, the various rods can be transferred on a conveyor system, passed through an appropriate enclosure, and subjected to application of appropriate heat (e.g., microwave radiation or convective heating). The cigarettes then can be packaged. Techniques and equipment for processing and handling manufactured cigarettes will be readily apparent to those having skill in the art of automated cigarette manufacture.

Figure 5:
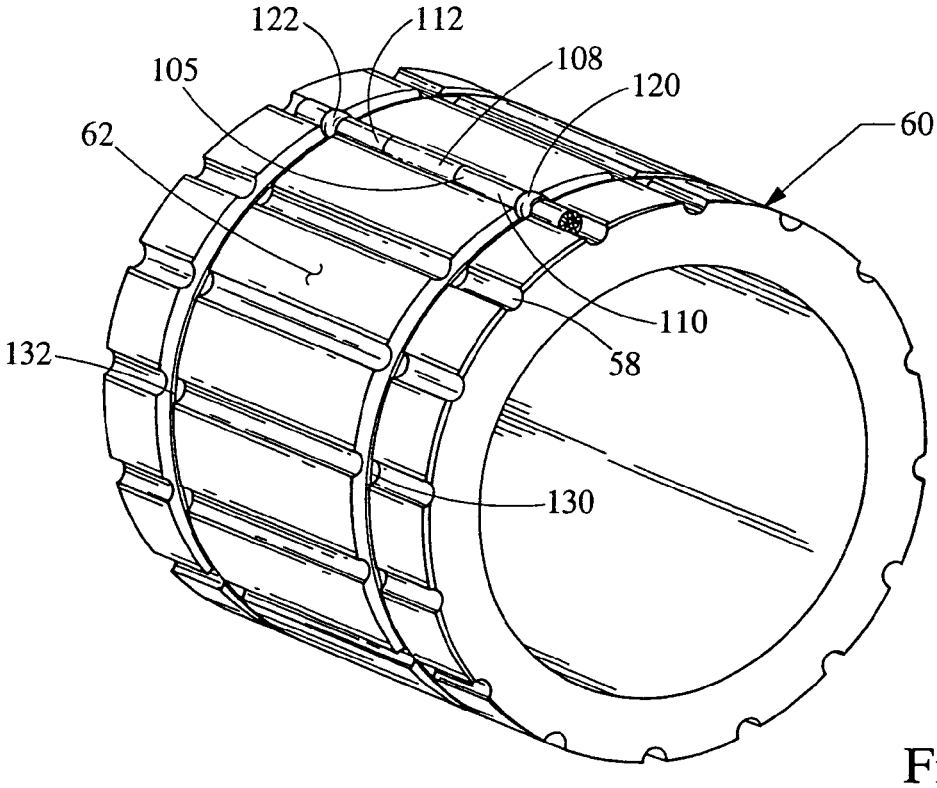
FIG. 5 is a perspective of one embodiment of the transfer drum shown in FIG. 1.

Referring to FIG. 5, there is shown transfer drum 60 and a two-up filtered cigarette rod 105 positioned in groove 58 of that drum. Groove 58 is one of a series of spaced grooves that are located on peripheral face 62 of drum 60. The two-up filtered cigarette rod 105 possesses a double filter 108, and a smokable rod 110, 112 at each end of that double filter. For the embodiment shown, one or more circumferential bands 120, 122, is applied to each respective smokable rod 110, 112. For the embodiment shown, the drum 60 includes two grooves 130, 132 that extend circumferentially around the peripheral face 62 of that drum. For the embodiment shown, each of the circumferentially extending grooves 130, 132 is positioned so as to be located adjacent to and below each respective band 120, 122 of the two-up filtered cigarette rod 105. As such, two-up filtered cigarette rod is positioned on the drum such that additive material applied to the wrapping material of each smokable rod to form a pattern thereon does not have a propensity to contact the drum directly. Hence, tendency of smearing, or other type of deformation or removal, of the additive material from the wrapping material is minimized or eliminated. The width and depth of the circumferentially extending grooves 130, 132 can vary, and the specific dimensions of those grooves can be determined by experimentation. For example, for a band of about 6 mm to about 7 mm width, a groove having a width of about 8 mm to about 10 mm and a depth of about 1 mm to about 5 mm can be employed. As such, undesirable wiping of applied material from the wrapping material of the tobacco rods is minimized or avoided. Manners and methods for providing transfer drums (and other relevant drums within the tipping machine) having such types of circumferentially extending grooves will be readily apparent to those having skill in the art of transfer drum design and manufacture.

Optionally, the techniques and equipment of the present invention can be used to apply patterns to wrapping materials of cigarettes that previously have had patterns applied to the wrapping materials thereof. Cigarettes having smokable rods possessing additive material applied as registered bands applied at predetermined and controlled locations to the inner surfaces of their wrapping materials can be manufactured using the types of techniques and equipment set forth in U.S. Patent Application Pub. No. 2003/0145869 to Kitao et al.; U.S. Patent Application Pub. No. 2003/0150466 to Kitao et al.; and U.S. patent application Ser. No. 10/645,996, filed Aug. 22, 2003 to Hancock; Ser. No. 10/665,066, filed Sep. 17, 2003 to Patel et al.; and Ser. No. 10/682,582, filed Oct. 9, 2003 to Fitzgerald et al.; which are incorporated herein by reference. Then, the techniques and equipment of the present invention can be used to apply bands at predetermined locations on the outer surfaces of those wrapping materials. As such, it is possible to apply a first pattern to the inner surface of the wrapping material of a cigarette rod; and then to apply a second pattern overlying that first pattern, the second pattern being applied to the outer surface of the wrapping material at a later time in the cigarette manufacturing process.

Cigarettes processed in the foregoing manner can have wide varieties of properties. The filter element regions of those cigarettes can be laser perforated or non-laser perforated. Most preferably, at least one band of additive material can be applied to the wrapping material of each smokable rod. For example, 1, 2, 3, or more, bands can be located at predetermined, spaced locations on the wrapping material of the smokable rod of each cigarette. The additive material within each band can be employed in order to alter the general composition or properties of the smoke generated during use of the cigarette, and/or to alter the general physical and performance characteristics of the cigarette during use.

Certain preferred cigarettes are designed to exhibit reduced ignition propensity. Of particular interest are those cigarettes possessing smokable rods manufactured using appropriate wrapping materials possessing bands composed of appropriate amounts of appropriate components so as to have the ability to meet certain cigarette extinction criteria. Also, of particular interest are those cigarettes possessing smokable rods manufactured using appropriate wrapping materials designed to possess appropriate numbers of bands having appropriate features and positioned at appropriate locations, so as to have the ability to meet certain cigarette extinction design criteria.

The paper wrapping material that is further processed to provide the patterned wrapping material can have a wide range of compositions and properties. The selection of a particular wrapping material will be readily apparent to those skilled in the art of cigarette design and manufacture. Typical paper wrapping materials are manufactured from fibrous materials, and optional filler materials, to form so-called "base sheets." Wrapping materials of the present invention can be manufactured without significant modifications to the production techniques or processing equipment used to manufacture those wrapping materials. Exemplary types of wrapping materials are set forth in U.S. patent application Pub. No. 2003/0131860 to Ashcraft et al. and U.S. patent application Ser. No. 10/645,996, filed Aug. 22, 2003 to Hancock; Ser. No. 10/665,066, filed Sep. 17, 2003 to Patel et al; and Ser. No. 10/682,582, filed Oct. 9, 2003 to Fitzgerald et al.; which are incorporated herein by reference.

Paper wrapping materials suitable for use in carrying out the present invention are commercially available. Representative cigarette paper wrapping materials have been available as Ref. Nos. 419, 454, 456, 460 and 473 Ecusta Corp.; Ref. Nos. Velin 413, Velin 430, VE 825 C20, VE 825 C30, VE 825 C45, VE 826 C24, VE 826 C30 and 856 DL from Miquel; Tercig LK18, Tercig LK24, Tercig LK38, Tercig LK46 and Tercig LK60 from Tervakoski; and Velin Beige 34, Velin Beige 46, Velin Beige 60, and Ref. Nos. 454 DL, 454 LV, 553 and 556 from Wattens. Other representative cigarette paper wrapping materials are available as 38 CORESTA unit Printed Diagonal Lines, 46 CORESTA unit Printed Diagonal Lines, 60 CORESTA unit Printed Diagonal Lines, 38 CORESTA unit Longitudinal Verge Lines, 46 CORESTA unit Longitudinal Verge Lines, 60 CORESTA unit Longitudinal Verge Lines, 46 CORESTA unit Beige Velin and 60 CORESTA unit Beige Velin from Trierenberg Holding. Exemplary flax-containing cigarette paper wrapping materials have been available as Grade Names 105, 114, 116, 119, 170, 178, 514, 523, 536, 520, 550, 557, 584, 595, 603, 609, 615 and 668 from Schweitzer-Mauduit International. Exemplary wood pulp-containing cigarette paper wrapping materials have been available as Grade Names 404, 416, 422, 453, 454, 456, 465, 466 and 468 from Schweitzer-Mauduit International.

Cigarettes are manufactured from wrapping materials that are supplied from rolls, and most preferably, from bobbins. The amount of wrapping material on a bobbin can vary, but the length of continuous strip of wrapping material on a bobbin typically is more than about 6,000 meters; and generally, the length of continuous strip of wrapping material on a bobbin typically is less than about 7,000 meters. The width of the wrapping material can vary, depending upon factors such as the circumference of the smokable rod that is manufactured and the width of the overlap region zone that provides for the sideseam. Typically, the width of a representative continuous strip of wrapping material is about 24 mm to about 30 mm.

The composition of the additive material or coating formulation can vary. Generally, the composition of the coating is determined by the ingredients of the coating formulation. Preferably, the coating formulation has an overall composition, and is applied in a manner and in an amount, such that the physical integrity of the wrapping material is not adversely affected when the coating formulation is applied to selected regions of the wrapping material. It also is desirable that components of the coating formulation not introduce undesirable sensory characteristics to the smoke generated by a smoke article incorporating a wrapping material treated with that coating formulation. Thus, suitable combinations of various components can act to reduce the effect of coatings on sensory characteristics of smoke generated by the smoking article during use. Preferred coatings provide desirable physical characteristics to cigarettes manufactured from wrapping materials incorporating those coatings. Preferred coatings also can be considered to be adhesives, as it is desirable for those coatings to remain in intimate contact with (e.g., to adhere to or otherwise remain secured to) desired locations on the wrapping material.

Examples of certain types of coating formulations and representative types of components thereof are set forth in U.S. Pat. No. 4,889,145 to Adams; and U.S. Pat. No. 5,060,675 to Milford et al.; U.S. patent applications Pub. Nos. 2003/0131860 to Ashcraft et al.; 2003/0145869 to Kitao et al. and 2003/0150466 to Kitao et al.; U.S. patent application Ser. No. 10/645,996, filed Aug. 22, 2003 to Hancock; Ser. No. 10/665,066, filed Sep. 17, 2003 to Patel et al; and Ser. No. 10/682,582, filed Oct. 9, 2003 to Fitzgerald et al.; PCT Application Pub. Nos. WO 02/043513; WO 02/055294; and European Patent Application 1,234,514. Other types of coating formulations and additive material formulations are described herein.

The coating formulation most preferably includes a film-forming agent. The solvent or liquid carrier for the coating formulation can vary. The coating formulation also can include a filler material. The coating formulations can incorporate other ingredients in addition to the aforementioned coating materials. The relative amounts of the various components of the coating formulation can vary. The amounts of other optional components of the coating formulation can vary.

Although highly preferred, film forming materials are not strictly necessary. For example, a suitable additive material formulation can incorporate a liquid carrier (e.g., water) and at least one salt and/or at least one flavoring agent dissolved and/or dispersed therein; and the salt and/or flavoring agent applied to the wrapping material of the wrapping material can permeate the wrapping material in order to remain in intimate contact therewith. Thus, it is possible to alter the sensory characteristics of the cigarette smoke of the cigarette or to alter the burn characteristics of the cigarette using those types of additive components.

The coating formulation typically has a liquid, syrup or paste form, and is applied as such. Depending upon the actual ingredients that are combined with the solvent, the coating formulation has the form of a solution, an emulsion (e.g., a water-based emulsion), or a liquid having solid materials dispersed therein. Generally, the film-forming agent is dissolved or dispersed in a suitable solvent to form the coating formulation. Certain other optional ingredients also are dissolved, dispersed or suspended in that formulation. Additionally, optional filler material also is dispersed within that formulation. Preferably, the filler material is essentially insoluble and essentially chemically non-reactive with the solvent, at least at those conditions at which the formulation is employed. Of particular interest are coating formulations having the form of what can be considered to be pastes. Typically, a paste (i) is formed by heating a mixture of water and a starch-based material sufficiently to hydrolyze the starch-based material, (ii) has a flowable, plastic-type fluid form, (iii) exhibits adhesive properties, and hence exhibits a tendency to maintain its position when applied to a substrate, and (iv) forms a desirable film upon drying.

Certain additive materials can be applied to the wrapping material in the form of a coating formulation that is in a so-called "solid polymer" form. That is, film-forming materials, such as ethylene vinyl acetate copolymers and certain starches, can be mixed with other components of the coating formation, and applied to the wrapping material without the necessity of dissolving those film-forming materials in a suitable solvent. Typically, solid polymer coating formulations are applied at elevated temperatures relative to ambient temperature; and the film-forming materials of those heated coating formulations typically have an extremely wide range of viscosities.

Coating formulations, such as the types of water-based coating formulations desired hereinbefore, most preferably are subjected to drying conditions after those formulations have been applied to a suitable substrate, such as a continuous strip of paper web of wrapping material. Preferably, sufficient solvent (e.g., water) is removed from the formulation after that formulation has been applied to the wrapping material such that the additive material that remains in contact with the wrapping material does not exhibit a sticky or tacky character or nature. Preferably, sufficient solvent (e.g., water) is removed from the formulation after that formulation has been applied to the wrapping material such that the additive material that remains in contact with the wrapping material exhibits a solvent (e.g., moisture) content of less than about 10 percent, more preferably less than about 8 percent, based on the weight of the additive material that remains in contact with the wrapping material. Typically, sufficient solvent (e.g., water) is removed from the formulation after that formulation has been applied to the wrapping material such that the additive material that remains in contact with the wrapping material exhibits a solvent (e.g., moisture) content of about 4 percent to about 6 percent, based on the weight of the additive material that remains in contact with the wrapping material.

The amount of coating formulation that is applied to the paper wrapping material can vary. Typically, coating of the wrapping material provides a coated wrapping material having an overall dry basis weight (i.e., the basis weight of the whole wrapping material, including coated and uncoated regions) of at least about 1.05 times, often at least about 1.1 times, and frequently at least about 1.2 times, that of the dry basis weight of that wrapping material prior to the application of coating thereto. Generally, coating of the wrapping material provides a coated paper having an overall dry basis weight of not more than about 1.5 times, typically about 1.4 times, and often not more than about 1.3 times, that of the dry basis weight of the wrapping material that has the coating applied thereto. Typical overall dry basis weights of those wrapping materials are about 20 $g/m^2$ to about 40 $g/m^2$; preferably about 25 $g/m^2$ to about 35 $g/m^2$. For example, a paper wrapping material having a dry basis weight of about 25 $g/m^2$ can be coated in accordance with the present invention to have a resulting overall dry basis weight of 26 $g/m^2$ to about 38 $g/m^2$, frequently about 26.5 $g/m^2$ to about 35 $g/m^2$, and often about 28 $g/m^2$ to about 32 $g/m^2$.

Typical coated regions of paper wrapping materials of the present invention that are suitable for use as the circumscribing wrappers of tobacco rods for cigarettes have inherent porosities that can vary. Typically, the inherent porosities of the coated regions of the wrapping materials are less than about 8.5 CORESTA units, usually are less than about 8 CORESTA units, often are less than about 7 CORESTA units, and frequently are less than about 6 CORESTA units. Typically, the inherent porosities of the coated regions of the wrapping materials are at least about 0.1 CORESTA unit, usually are at least about 0.5 CORESTA unit, often are at least about 1 CORESTA unit. Preferably, the inherent porosities of the coated regions of the wrapping materials, particularly those wrapping materials that are used for the manufacture of cigarettes designed to meet certain cigarette extinction test criteria, are between about 0.1 CORESTA unit and about 4 CORESTA units.

The paper wrapping material of the present invention can be coated in patterns having predetermined shapes. Various types of patterns are set forth in U.S. patent application Ser. No. 10/682,582, filed Oct. 9, 2003 to Fitzgerald et al. Preferably, the coating can have the form of bands, cross directional lines or bands (including those that are perpendicular to the longitudinal axis of the wrapping material).

The relative sizes or dimensions of the various shapes and designs can be selected as desired. For example, shapes of coated regions, compositions of the coating formulations, or amounts or concentrations of coating materials, can change over the length of the wrapping material. The relative positioning of the printed regions can be selected as desired. For example, for wrapping materials that are used for the production of cigarettes designed to meet certain cigarette extinction test criteria, the pattern most preferably has the form of spaced continuous bands that are aligned transversely or cross directionally to the longitudinal axis of the wrapping material. However, cigarettes can be manufactured from wrapping materials possessing discontinuous bands positioned in a spaced apart relationship. For wrapping materials of those cigarettes, it is most preferred that discontinuous bands (e.g., bands that are composed of a pattern, such as a series of dots, grids or stripes) cover at least about 70 percent of the surface of the band area or region of the wrapping material.

Preferred wrapping materials possess coatings in the form of bands that extend across the wrapping material, generally perpendicular to the longitudinal axis of the wrapping material. The widths of the individual bands can vary, as well as the spacings between those bands. Typically, those bands have widths of at least about 0.5 mm, usually at least about 1 mm, frequently at least about 2 mm, and most preferably at least about 3 mm. Typically, those bands have widths of up to about 8 mm, usually up to about 7 mm. Preferred bands have widths of about 4 mm to about 7 mm, and often have widths of about 6 mm to about 7 mm.

There are several factors that determine a specific coating pattern for a wrapping material of the present invention. It is desirable that the components of the coating formulations applied to wrapping materials not adversely affect to any significant degree (i) the appearance of cigarettes manufactured from those wrapping materials, (ii) the nature or quality of the smoke generated by those cigarettes, (iii) the desirable burn characteristics of those cigarettes, or (iv) the desirable performance characteristics of those cigarettes. It also is desirable that wrapping materials having coating formulations applied thereto not introduce undesirable off-taste, or otherwise adversely affect the sensory characteristics of the smoke generated by cigarettes manufactured using those wrapping materials. In addition, preferred cigarettes of the present invention do not have a tendency to undergo premature extinction, such as when lit cigarettes are held in the smoker's hand or when placed in an ashtray for a brief period of time.

Cigarettes designed to meet certain cigarette extinction test criteria can be produced from wrapping materials of the present invention. Banded regions on a wrapping material are produced using additive materials that are effective in reducing the inherent porosity of the wrapping material in those regions. Film-forming materials and fillers applied to the wrapping material in those banded regions are effective in increasing the weight of the wrapping material in those regions. Filler materials that are applied to the wrapping material in those banded regions are effective in decreasing the bum rate of the wrapping materials in those regions. Typically, when wrapping materials of relatively high inherent porosity are used to manufacture cigarettes, those wrapping materials possess relatively high weight bands that introduce a relatively low inherent porosity to the banded regions. Film-forming materials have a tendency to reduce the porosity of the wrapping material, whether or not those materials are used in conjunction with fillers. However, coatings that combine porosity reduction with added coating weight to wrapping materials also are effective in facilitating extinction of cigarettes manufactured from those wrapping materials. Low porosity in selected regions of a wrapping material tends to cause a lit cigarette to extinguish due to the decrease in access to oxygen for combustion for the smokable material within that wrapping material. Increased weight of the wrapping material also tends to cause a lit cigarette incorporating that wrapping material to extinguish. As the inherent porosity of the wrapping material increases, it also is desirable to (a) select a film-forming material so as to cause a decrease the inherent porosity of the coated region of the wrapping material and/or (b) provide a coating that provides a relatively large amount of added weight to the coated region of the wrapping material.

Cigarettes of the present invention can possess certain appropriately treated wrapping materials of the present invention. The wrapping material can possess patterns of predetermined shapes and sizes positioned at predetermined locations, and hence, cigarettes appropriately manufactured from that wrapping material can possess patterns of predetermined shapes and sizes positioned at predetermined locations on their smokable rods. The wrapping material can possess patterns of predetermined composition positioned at predetermined locations, and hence, cigarettes appropriately manufactured from that wrapping material can possess patterns of predetermined composition positioned at predetermined locations on their smokable rods. The foregoing types of patterns can introduce certain properties or behaviors to specific regions of those smokable rods (e.g., the patterns can provide specific regions of increased weight, decreased permeability and/or increased burn retardant composition to wrapping material). For example, a wrapping material that possesses bands that surround the column of smokable material of the smokable rod and that decrease the permeability of the wrapping material (e.g., the wrapping material can have bands applied thereto and the bands can be positioned thereon) can be such that each acceptable smokable rod manufactured from that wrapping material can possess at least two identical bands on the wrapping material surrounding the tobacco column, and the spacing between the bands, measured from the inside adjacent edges of the bands, is preferably no less than 15 mm and no greater than 25 mm.

Certain preferred cigarettes incorporate banded wrapping materials for the column of smokable material. The wrapping material of each preferred smokable rod can possess at least one band. Alternatively, the wrapping material of each preferred smokable rod can possess at least two bands, and those bands can be virtually identical. The band spacing on the wrapping material can vary. Typically, bands are spaced about 15 mm to about 60 mm apart, often about 15 mm to about 45 mm apart, and frequently about 15 mm to about 30 mm apart. Certain cigarettes can possess bands that are spaced on the wrapping materials of those cigarettes such that each cigarette possesses a band or bands of the desired configuration and composition in essentially identical locations on each tobacco rod of each cigarette. Those cigarettes, which have tobacco rods having appropriate wrapping materials possessing bands composed of appropriate amounts of appropriate components, have the ability to meet the aforementioned cigarette extinction criteria.

Cigarettes of the present invention possessing tobacco rods manufactured using certain appropriately treated wrapping materials of the present invention, when tested using the methodology set forth in the Cigarette Extinction Test Method by the National Institute of Standards and Technology (NIST), Publication 851 (1993) using 10 layers of Whatman No. 2 filter paper, meet criteria requiring extinction of greater than about 50 percent, preferably greater than about 75 percent, and most preferably about 100 percent, of cigarettes tested. Certain cigarettes of the present invention possessing tobacco rods manufactured using certain appropriately treated wrapping materials of the present invention, when tested using the methodology set forth in the methodology set forth in ASTM Designation: E 2187-02b using 10 layers of Whatman No. 2 filter paper, meet criteria requiring extinction of greater than about 50 percent, preferably greater than about 75 percent, and most preferably about 100 percent, of cigarettes tested. Preferably, each cigarette possesses at least one band located in a region of its tobacco rod such that the band is capable of providing that cigarette with the ability to meet those cigarette extinction criteria.

Cigarettes of the present invention can be manufactured from a variety of components, and can have a wide range of formats and configurations. Typical cigarettes of the present invention having cross directional bands applied to the wrapping materials of the tobacco rods of those cigarettes (e.g., virtually perpendicular to the longitudinal axes of those cigarettes) have static burn rates (i.e., burn rates of those cigarettes under non-puffing conditions) of about 50 to about 60 mg tobacco rod weight per minute, in the non-banded regions of those cigarettes. Typical cigarettes of the present invention having cross directional bands applied to the wrapping materials of the tobacco rods of those cigarettes have static burn rates (i.e., burn rates of those cigarettes under non-puffing conditions) of less than about 50 mg tobacco rod weight per minute, preferably about 40 to about 45 mg tobacco rod weight per minute, in the banded regions of those cigarettes.

The tobacco materials used for the manufacture of cigarettes of the present invention can vary. Descriptions of various types of tobaccos, growing practices, harvesting practices and curing practices are set for in *Tobacco Production, Chemistry and Technology*, Davis et al. (Eds.) (1999). The tobacco normally is used in cut filler form (e.g., shreds or strands of tobacco filler cut into widths of about 1/10 inch to about 1/60 inch, preferably about 1/20 inch to about 1/35 inch, and in lengths of about 1/4 inch to about 3 inches). The amount of tobacco filler normally used within a cigarette ranges from about 0.6 g to about 1 g. The tobacco filler normally is employed so as to fill the tobacco rod at a packing density of about 100 mg/cm$^3$ to about 300 mg/cm$^3$, and often about 150 mg/cm$^3$ to about 275 mg/cm$^3$. Tobaccos can have a processed form, such as processed tobacco stems (e.g., cut-rolled or cut-puffed stems), volume expanded tobacco (e.g., puffed tobacco, such as propane expanded tobacco and dry ice expanded tobacco (DIET)), or reconstituted tobacco (e.g., reconstituted tobaccos manufactured using paper-making type or cast sheet type processes).

Typically, tobacco materials for cigarette manufacture are used in a so-called "blended" form. For example, certain popular tobacco blends, commonly referred to as "American blends," comprise mixtures of flue-cured tobacco, burley tobacco and Oriental tobacco, and in many cases, certain processed tobaccos, such as reconstituted tobacco and processed tobacco stems. The precise amount of each type of tobacco within a tobacco blend used for the manufacture of a particular cigarette brand varies from brand to brand. See, for example, *Tobacco Encyclopedia*, Voges (Ed.) p. 44-45 (1984), Browne, *The Design of Cigarettes*, 3$^{rd}$ Ed., p. 43 (1990) and *Tobacco Production, Chemistry and Technology*, Davis et al. (Eds.) p. 346 (1999). Other representative tobacco blends also are set forth in U.S. Pat. No. 4,836,224 to Lawson et al.; U.S. Pat. No. 4,924,888 to Perfetti et al.; U.S. Pat. No. 5,056,537 to Brown et al.; U.S. Pat. No. 5,159,942 to Brinkley et al.; U.S. Pat. No. 5,220,930 to Gentry; U.S. Pat. No. 5,360,023 to Blakley et al.; and U.S. Pat. No. 5,714,844 to Young et al.; U.S. patent applications Pub. Nos. 2002/0000235; 2003/0075193; and 2003/0131859; PCT Application Pub. No. WO 02/37990; U.S. patent application Ser. No. 10/285,395, filed Oct. 31, 2002 and Ser. No. 10/463,211, filed Jun. 17, 2003; and Bombick et al., *Fund. Appl. Toxicol.*, 39, p. 11-17 (1997); which are incorporated herein by reference.

If desired, in addition to the aforementioned tobacco materials, the tobacco blend of the present invention can further include other components. Other components include casing materials (e.g., sugars, glycerin, cocoa and licorice) and top dressing materials (e.g., flavoring materials, such as menthol). The selection of particular casing and top dressing components is dependent upon factors such as the sensory characteristics that are desired, and the selection of those components will be readily apparent to those skilled in the art of cigarette design and manufacture. See, Gutcho, *Tobacco Flavoring Substances and Methods*, Noyes Data Corp. (1972) and Leffingwell et al., *Tobacco Flavoring for Smoking Products* (1972).

Smoking articles also can incorporate at least one flavor component within the side seam adhesive applied to the wrapping material during the manufacture of the tobacco rods. That is, for example, various flavoring agents can be incorporated in a side seam adhesive CS-220 1A available from R. J. Reynolds Tobacco Company, and applied to the seam line of the wrapping material. Those flavoring agents are employed in order to mask or ameliorate any off-taste or malodor provided to the smoke generated by smoking articles as a result of the use of the wrapping materials of the present invention, such as those wrapping materials having coating formulations incorporating certain cellulosic-based or starch-based components applied thereto. Exemplary flavors include methyl cyclopentenolone, vanillin, ethyl vanillin, 4-parahydroxyphenyl-2-butanone, gamma-undecalactone, 2-methoxy-4-vinylphenol, 2-methoxy-4-methylphenol, 5-ethyl-3-hydroxy-4-methyl-2(5H)-furanone, methyl salicylate, clary sage oil and sandalwood oil. Typically, such types of flavor components are employed in amounts of about 0.2 percent to about 6.0 percent, based on the total weight of the adhesive and flavor components.

Cigarettes preferably have a rod shaped structure and a longitudinal axis. Such cigarettes each have a column of smokable material circumscribed by wrapping material of the present invention. Preferably, the wrapping material encircles the outer longitudinally extending surface of the column of smokable material, and each end of the cigarette is open to expose the smokable material. Exemplary cigarettes, and exemplary components, parameters and specifications thereof, are described in U.S. Pat. No. 5,220,930 to Gentry; PCT WO 02/37990 and U.S. Patent Application 2002/0166563; which are incorporated herein by reference. Representative filter element components and designs are described in Browne, *The Design of Cigarettes*, 3$^{rd}$ Ed. (1990); *Tobacco Production, Chemistry and Technology*, Davis et al. (Eds.) 1999; U.S. Pat. No. 4,508,525 to Berger; U.S. Pat. No. 4,807,809 to Pryor et al.; U.S. Pat. No. 4,920,990 to Lawrence et al.; U.S. Pat. No. 5,012,829 to Thesing et al.; U.S. Pat. No. 5,025,814 to Raker; U.S. Pat. No. 5,074,320 to Jones, Jr. et al.; U.S. Pat. No. 5,101,839 to Jakob et al.; U.S. Pat. No. 5,105,834 to Saintsing et al.; U.S. Pat. No. 5,105,838 to White et al.; U.S. Pat. No. 5,271,419 to Arzonico et al.; U.S. Pat. No. 5,360,023 to Blakley et al; U.S. Pat. No. 5,595,218 to Koller et al.; U.S. Pat. No. 5,718,250 to Banerjee et al.; and U.S. Pat. No. 6,537,186 to Veluz; U.S. patent applications Pub Nos. 2002/0014453; 2002/0020420; and 2003/0168070; U.S. patent application Ser. No. 10/600,712, filed Jun. 23, 2003, to Dube et al.; PCT Application Pub. No. WO 03/059096 to Paine et al.; and European Patent No. 920816. Representative filter materials can be manufactured from tow materials (e.g., cellulose acetate or polypropylene tow) or gathered web materials (e.g., gathered webs of paper, cellulose acetate, polypropylene or polyester). Certain filter elements can have relatively high removal efficiencies for selected gas phase components of mainstream smoke.

Although the present invention has been described with reference to particular embodiments, it should be recognized that these embodiments are merely illustrative of the principles of the present invention. Those of ordinary skill in the art of smoking article design and manufacture will appreciate that the various systems, equipment and methods may be constructed and implemented in other ways and embodiments. Accordingly, the description herein should not be read as limiting the present invention, as other embodiments also fall within the scope of the present invention.

The invention claimed is:

1. An apparatus for producing a cigarette having additive material applied to the outer wrapper thereof, the apparatus comprising:

(a) means for supplying two formed cigarette rods, a double length filter element therebetween, and a tipping material as components of a two-up cigarette assembly;

(b) means for rotating the cigarette assembly about its longitudinal axis in a controlled manner to form a two-up cigarette from the two formed cigarette rods, the double length filter element and the tipping material, said means for rotating comprising (i) a roll drum, and (ii) a cooperating roll block; and (c) means for applying a predetermined pattern of an additive material to at least one predetermined region of each cigarette rod as the cigarette assembly is rotated on said means for rotating, wherein the means for applying comprises a plurality of printing surfaces on the roll drum, each one of the plurality of printing surfaces having an elongated shape that extends essentially perpendicularly to a longitudinal direction of the cigarette assembly, and wherein the roll drum has a plurality of transverse grooves sized for supporting the two-up cigarette, and each transverse groove has a plurality of recesses aligned with the predetermined region where the additive material is applied to the two-up cigarette.

2. The apparatus of claim 1, wherein the means for applying a predetermined pattern of the additive material further comprises at least one application means.

3. The apparatus of claim 2, wherein the application means comprises a spray nozzle, a spray jet or a brush proximate the means for rotating.

4. The apparatus of claim 1, wherein the means for applying further comprises a transfer roller for transferring the additive material to the plurality of printing surfaces.

5. The apparatus of claim 4, wherein the plurality of printing surfaces is raised above a peripheral face of the roll drum and the plurality of printing surfaces has the form of the predetermined pattern.

6. The apparatus of claim 2, wherein the application means comprises a spray nozzle, a spray jet or a brush proximate the roll block.

7. A method for producing a cigarette having additive material applied to the outer wrapper thereof, the method comprising:

(a) supplying two formed cigarette rods, a double length filter element therebetween, and a tipping material as components of a two-up cigarette assembly;

(b) rotating the cigarette assembly about its longitudinal axis on a roll drum cooperating with a roll back in a controlled manner to form a two-up cigarette from the two formed cigarette rods, the double length filter element and the tipping material;

(c) applying a predetermined pattern of an additive material to at least one predetermined region of each cigarette rod as the two-up cigarette assembly is rotated on the roll drum, wherein the predetermined pattern of the additive material is applied using a plurality of printing surfaces on the roll drum, each one of the plurality of printing surfaces having an elongated shape that extends essentially perpendicularly to a longitudinal direction of the cigarette assembly; and (d) after applying the additive material, rotating the two-up cigarette assembly into a groove in the roll drum such that the predetermined region is over a recess in the groove.

8. The method of claim 7, wherein the predetermined pattern of the additive material is applied further using at least one application means.

9. The method of claim 7, further comprising applying a second predetermined pattern of the additive material to the predetermined region of the cigarette rod over the predetermined pattern applied in step (c).

10. The method of claim 7, wherein the applying the predetermined pattern comprises applying a band circumscribing the two-up cigarette.

11. The method of claim 7, wherein the applying the predetermined pattern comprises transferring the additive material from a transfer roller to the plurality of printing surfaces on the roll drum, and rolling the two-up cigarette across the plurality of printing surfaces having the additive material.

12. The method of claim 7, further comprising maintaining the roll drum at an elevated temperature above ambient temperature to enhance drying of the additive material.

13. The method of claim 7, further comprising directing heated air to the predetermined region of the two-up cigarette after the additive material is applied.

14. An apparatus for producing a cigarette having additive material applied to the outer wrapper thereof, the apparatus comprising:

(a) means for supplying two formed cigarette rods, a double length filter element therebetween, and a tipping material as components of a two-up cigarette assembly;

(b) means for rotating the cigarette assembly about its longitudinal axis in a controlled manner to form a two-up cigarette from the two formed cigarette rods, the double length filter element and the tipping material, said means for rotating comprising a roll drum and a cooperating roll block, the roll drum comprising a plurality of printing surfaces and a plurality of transverse grooves sized for supporting the two-up cigarette, each transverse groove having a plurality of recesses aligned with a predetermined region where an additive material is applied to the two-up cigarette; and (c) means for applying a predetermined pattern of the additive material to at least one predetermined region of each cigarette rod as the cigarette assembly is rotated on said means for rotating, the means for applying comprising the plurality of printing surfaces and a transfer roller for transferring the additive material to the plurality of printing surfaces, wherein each one of the plurality of printing surfaces has an elongated shape that extends essentially perpendicularly to a longitudinal direction of the cigarette assembly, is raised above a peripheral face of the roll drum, and has the form of the predetermined pattern, wherein the predetermined pattern is a longitudinal band.

15. A method for producing a cigarette having additive material applied to the outer wrapper thereof, the method comprising:

(a) supplying two formed cigarette rods, a double length filter element therebetween, and a tipping material as components of a two-up cigarette assembly;

(b) rotating the cigarette assembly about its longitudinal axis on a roll drum cooperating with a roll back in a controlled manner to form a two-up cigarette from the two formed cigarette rods, the double length filter element and the tipping material;

(c) applying a predetermined pattern of an additive material to at least one predetermined region of each cigarette rod as the two-up cigarette assembly is rotated on the roll drum, wherein the predetermined pattern of the additive material is applied using a plurality of printing surfaces on the roll drum, each one of the plurality of printing surfaces having an elongated shape that extends essentially perpendicularly to a longitudinal direction of the cigarette assembly; and (d) applying a second predetermined pattern of the additive material to the predetermined region of the cigarette rod over the predetermined pattern applied in step (c).

* * * * *

UNITED STATES PATENT AND TRADEMARK OFFICE

CERTIFICATE OF CORRECTION

PATENT NO. : 7,296,578 B2
APPLICATION NO. : 10/793179
DATED : November 20, 2007
INVENTOR(S) : Louis John Read, Jr.

It is certified that error appears in the above-identified patent and that said Letters Patent is hereby corrected as shown below:

Column 19, in claim 7, line 8, after "cooperating with a roll" delete "back" and substitute --block-- in its place.

Column 20-21, in claim 15, line 8, after "cooperating with a roll" delete "back" and substitute --block-- in its place.

Signed and Sealed this

Twenty-seventh Day of May, 2008

JON W. DUDAS
*Director of the United States Patent and Trademark Office*